United States Patent [19]

Jensen

[11] Patent Number: 4,698,068

[45] Date of Patent: Oct. 6, 1987

[54] FIRE STARTER

[76] Inventor: Eric Jensen, 735 Bayshore Dr., Tarpon Springs, Fla. 33589

[21] Appl. No.: 778,409

[22] Filed: Sep. 20, 1985

[51] Int. Cl.[4] ..... C10L 11/00

[52] U.S. Cl. ..... 44/39; 431/269; 431/273

[58] Field of Search ..... 44/39; 431/273, 269

[56] References Cited

U.S. PATENT DOCUMENTS

| | | | |
|---|---|---|---|
| D. 211,399 | 6/1968 | Martin | D50/4 |
| D. 276,085 | 10/1984 | Ostman | D27/30 |
| 2,059,807 | 11/1936 | Ringer | 67/7 |
| 2,496,840 | 2/1950 | Alexander | 431/273 |
| 3,402,029 | 9/1968 | Sampson, Jr. et al. | 44/39 |
| 4,188,192 | 2/1980 | Levenson et al. | 44/39 |

*Primary Examiner*—Carl F. Dees

*Attorney, Agent, or Firm*—Dominik, Stein, Saccocio & Reese

[57] ABSTRACT

A fire igniting device which includes a rod of an ignitable material, particularly magnesium, and has a pyrophoric element adhered to the rod along its length. A head is secured to the rod, and also may be fitted to a case, so that a spent rod can be removed and discarded from a handle, and another rod installed. The case is adapted to receive the rod during periods of non-use, to protect it from contaminants; and, during use, the case may be fitted to the other end of the head so as to increase the effective length of the head and provide a more comfortable grip to the user. A metal striker for striking the pyrophoric element is conveniently tethered to the case. Magnesium shavings are scraped from the rod, and are then ignited by striking the pyrophoric element with the striker. The fire igniting device may be incorporated into the handle of a survival knife, whereby the handle functions as a case for the magnesium rod during periods of non-use.

7 Claims, 4 Drawing Figures

FIRE STARTER

BACKGROUND OF THE INVENTION

1. Field of the Invention

This invention relates generally to a fire igniting device having a shavable rod member composed of magnesium to which is secured a pyrophoric element. The fire igniting method is accomplished by scraping magnesium shavings from the rod and then igniting the same by sparks created by striking the pyrophoric element.

2. Description of the Background Art

Presently there exist many types of fire igniting devices capable of igniting tinder or kindling or the like. Obviously, the most prevalent igniting device is the conventional wooden or paper match containing a deposit of sulfur on its end which ignites upon striking of a rough surface. Other widely used devices include various types of lighters, sometimes referred to as cigarette lighters, in which a supply of fuel, such as butane, alcohol or the like, is stored within the body of the lighter and dispensed therefrom to be ignited from a spark generated by a rotating wheel/flint combination or even a piezo-electric.

Due to the many disadvantages and limitations of conventional matches and lighters, there have been developed more rugged igniting devices composed of a rod of ignitable material such as magnesium. During use, an amount of magnesium particles is created by scraping the magnesium rod with a rough instrument such as a piece of hacksaw blade. The pile of magnesium particles is then ignited by sparking. Due to the relatively low ignition temperature of the magnesium particles, the particles rapidly ignite, causing a significantly hot fire sufficient to ignite tinder and kindling positioned adjacent thereto.

U.S. Pat. No. 3,402,029 discloses a magnesium fire igniting device which functions basically in the manner described above but includes the step of creating the sparking by striking the rod itself to generate sparks therefrom. In order to provide for a better means for sparking, improved devices have been invented in which a pyrophoric element is adhered to the magnesium stock such as that disclosed in U.S. Pat. No. 4,188,192. During use of this improved device, the user creates a pile of the magnesium particles by shaving the magnesium rod with a tool and then with possibly the same tool, creates the sparking by striking the pyrophoric element. Finally, other relevant fire igniting devices are disclosed in U.S. Pat. Nos. Des. 211,399, Des. 276,085, Des. 217,069 and 2,059,807.

While the above disclosed devices have worked suitably well, it is apparent that some disadvantages are associated with them. Specifically, they lack any specific type of sheath or container for storing the device during nonuse. Additionally, while U.S. Pat. No. 3,402,029 discloses a handle affixed to the magnesium rod, it is clear that once the rod is consumed during use, that the handle must be discarded. Hence, the cost of the device is substantially increased.

Therefore, it is an object of this invention to provide a method which overcomes the aforementioned inadequacies of the prior art methods and provides an improvement which is a significant contribution to the advancement of fire ignition art.

Another object of this invention to provide a fire igniting device including sheath or container means for containing the same during nonuse.

Another object of this invention is to provide a fire igniting device including a sheath or container means which may doubly function as a handle during use.

Another object of this invention is to provide a fire igniting device which may be incorporated into a survival knife or the like.

Another object of this invention is to provide a fire igniting device which allows the magnesium rod to be removed from the handle means and replaced with a new magnesium rod thereby avoiding the cost of discarding the handle when the rod is consumed.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure contained herein and in the above identified patents, the disclosure of which is hereby incorporated by reference herein. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a fire igniting device composed of a magnesium rod and having a pyrophoric element adhered along its length. The device further comprises a head removably secured to the magnesium rod allowing a spent magnesium rod to be removed and discarded from the handle and another magnesium rod installed. The device still further comprises a case into which is stored the magnesium rod during nonuse in such a manner that the magnesium rod is protected from contaminants, water, and the like. During use, the case may be fitted to the other end of the head to increase the effective length of the head and provide a more comfortable grip to the user of the device. A metal striker for striking the pyrophoric element is tethered to the case for striking the pyrophoric element to create sparking.

In other applications, the fire igniting device of the invention is incorporated into the handle of a survival knife in such a manner that the handle of the survival knife functions as a case for the magnesium rod during nonuse. During use, the head of the magnesium rod, along with the magnesium rod, is removed from the knife's handle and can be struck using the blade of the knife.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
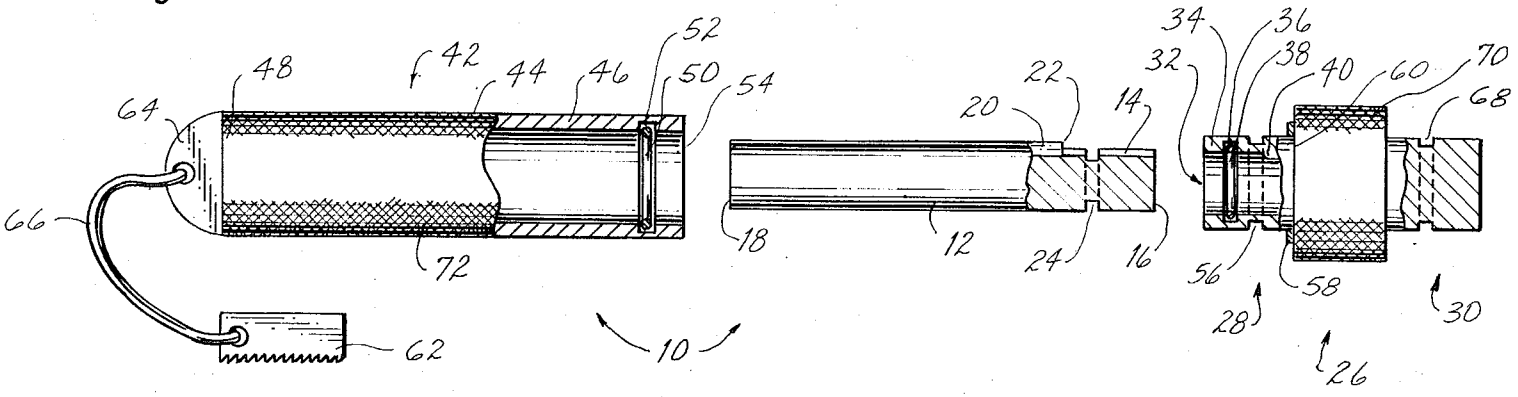
FIG. 1 is an exploded view of the fire igniting device of the invention, partially in cross-section, illustrating the manner in which the magnesium rod is removably secured to a head and the manner in which the head is removably secured to a case in which the magnesium rod is stored.

Referring to FIG. 1, the fire igniting device 10 of the invention comprises a magnesium rod 12, preferably circular in cross-section, containing a groove 14, preferably semicircular in cross-section, formed along its length from its proximal end 16 to its distal end 18. A pyrophoric element 20, preferably circular in cross-section, is adhesively secured within groove 14 from the distal end 18 of the magnesium rod 12 to a point, generally represented by numeral 22, disposed a distance appreciably from the proximal end 16 of the rod 12. Another groove 24 is circumferentially formed in the magnesium rod 12 at a position between point 22 and the proximal end 16 of the rod 12.

The fire igniting device 10 of the invention further includes head 26 having a substantially circular cross-sectional configuration. Head 26 includes a rod receiving end 28 and a case receiving end 30. The rod receiving end 28 of the head 26 includes a circular blind recess 32 defined by circular sidewall 34 and dimensioned to receive the proximal end 16 of the magnesium rod 12. A groove 36 is circumferentially formed within the lumen of recess 32. A spring clip 38 is positioned within groove 36. Preferably, spring clip 38 comprises a circular segment of spring steel dimensioned to loosely fit within groove 36 and during flexing, to slide over the proximal end 16 of the magnesium rod 12 to engage into groove 24 of the rod 12. Finally, a keyway protrusion 40 is formed within recess 32 to engage into groove 14 of the magnesium rod 12 when installed in the circular recess 32.

From the foregoing description, it should be apparent that the magnesium rod 12 can be quickly and easily attached to and removed from the head 26 of the invention. More particularly, the magnesium rod 12 is easily installed within circular recess 32 by simply pushing the proximal end 16 of the rod 12 into the circular recess 32 whereupon spring clip 38 flexes and slips over the proximal end 16. The magnesium rod 12 is rotated to align groove 14 with keyway protrusion 40 and then the magnesium rod 12 is further pushed into the recess 32 until spring clip 38 snaps into groove 24 located in the proximal end 16 of the rod 12. The magnesium rod 12 is therefore rigidly secured within recess 32 of the head 26. During removal of the magnesium rod 12 from the head 26, the rod 12 is simply pulled from the head 26 whereupon the spring clip 38 flexes to snap out of groove 24 of the proximal end 16 of the rod 12 thereby releasing the rod 12 from the head 26.

It is noted that while spring clip 38 cooperating with grooves 36 and 24 functions to releasably secure the rod 12 into the recess 32 of head 26, many other alternative embodiments may be provided without departing from the spirit and scope of this invention. For example, the proximal end 16 of the rod 12 may be provided with external threads which engage into internal threads disposed within the lumen within recess 32. In another example, the proximal end 16 of rod 12 may be provided with a spring loaded ball bearing positioned at the side of the proximal end 16 of the rod 12 to releasably engage into a groove formed within the side wall 34 of recess 32. Alternatively, a spring loaded ball bearing may be positioned within side wall 34 to engage into a groove formed within the proximal end 16 of the rod 12.

The fire igniting device 10 of the invention still further comprises a case 42 designed to receive the magnesium rod 12 to prevent contamination of the same. Preferably, case 42 comprises a cylindrical blind tube 44 defined by side wall 46 and bottom wall 48. Similar to spring clip 38 and groove 36 of the head 26, the case 42 includes a spring clip 50 loosely fitted within groove 52 near the opening 54 of the case 42. Spring clip 52 cooperates with another groove 56 exteriorly formed within side wall 34 of the head 26 to function in a manner nearly identical to spring clip 38 and grooves 36 and 24. Hence, the head 26, together with the magnesium rod 12 when installed thereto, may be quickly and easily fitted into the opening 54 of the case 42 to prevent contamination of the magnesium rod 12 during nonuse. Washer means 58 may be fitted about the lip 60 of the head 26 to sealingly engage the edge of the opening 54 of case 42. Additionally, a steel striker 62, such as a segment of a hacksaw blade, may be tethered to the lower end 64 of the case 42 by a flexible member 66 such as a leather thong. As disclosed herein above, striker 62 provides means for shaving magnesium particles from the magnesium rod 12 and then igniting the same upon striking the pyrophoric element 20 with the striker 62.

Figure 2:
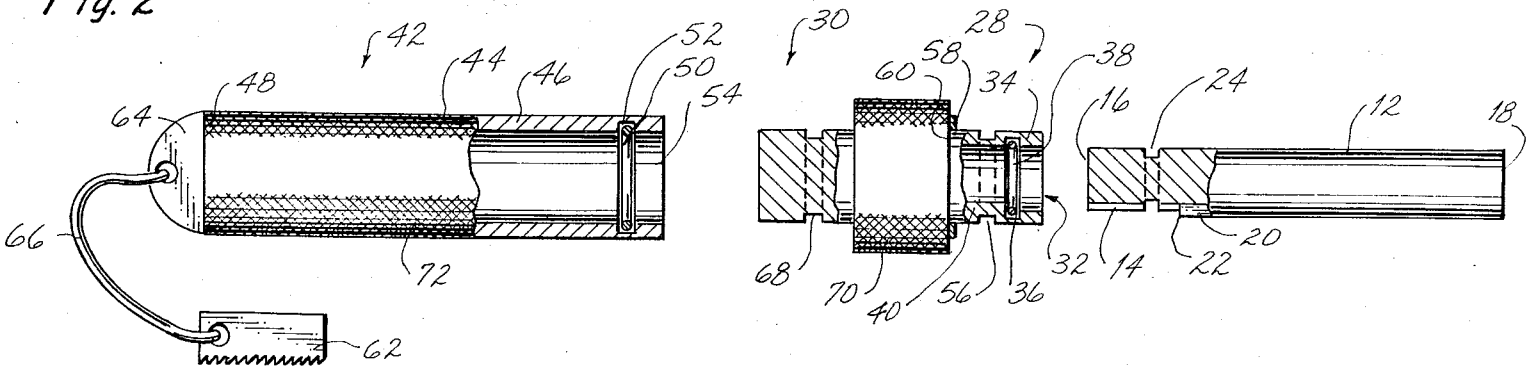
FIG. 2 is another exploded view of the fire igniting device of the invention, partially in cross-section, illustrating the manner in which the head and magnesium rod can be removed from the case and the case refitted to the other end of the head to provide handle means for more comfortable grip to the user.

Head 26 of the fire igniting device 10 further includes the feature of being able to be refitted to case 42 in such a manner that case 42 increases the effective length of the head 26 thereby creating a comfortable handle for gripping by the user of the igniting device 10. More particularly, the case receiving end 30 of the head 26 includes a groove 68 which cooperates with spring clip 50 of the case 42 in a manner nearly identical as that described above in conjunction with spring clip 50 and groove 56. Thus, it should be readily apparent that when the head 26 together with the magnesium rod 12 is removed from the case 42, the head 26 and rod 12 may be inverted, allowing case receiving end 30 to be fitted into the opening 54 of case 42, such as that illustrated in FIG. 2. Furthermore, the exterior surfaces 70 and 72 of the head 26 and the case 42, respectively, may be knurled to provide a non-slip surface on such surfaces.

Figure 3:
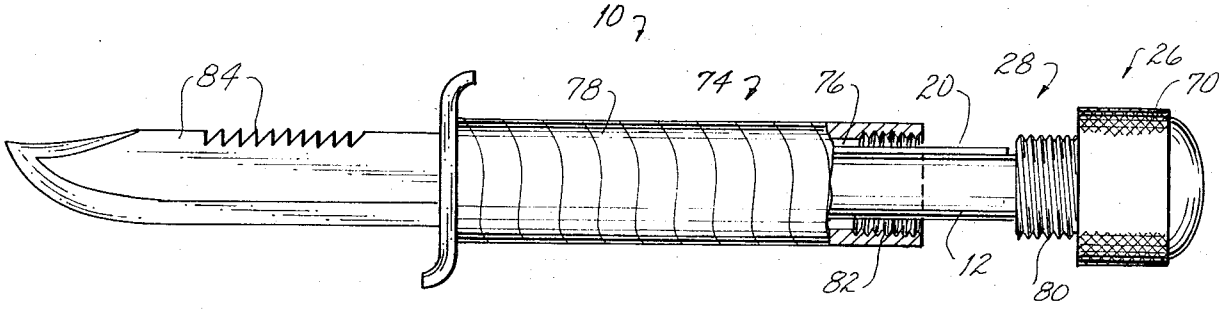
FIG. 3 is still another exploded view of the fire igniting device of the invention for use in conjunction with a conventional survival knife in which the head is adapted to fit into the butt of the knife with the magnesium rod stored within the handle of the knife.

Referring to FIG. 3, the fire igniting device 10 of the invention may alternatively be incorporated with a conventional survival knife 74 containing a blind hole 76 positioned within its handle 78. In this embodiment, side wall 34 of the rod receiving end 28 of head 26 includes threads 80 for threaded engagement with the threads 82 formed within the blind hole 76 of handle 78. In this embodiment, it is contemplated that blade portion 84 of the survival knife 74 would function in a manner similar to striker 62 to shave magnesium particles from rod 12 and to ignite the same upon striking the pyrophoric element 20.

Figure 4:
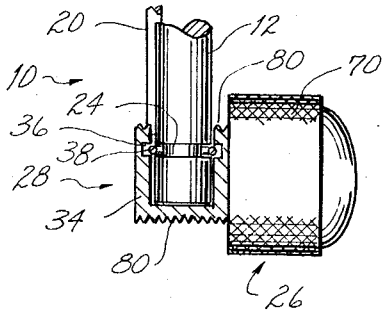
FIG. 4 is another view, partially a cross-section, of an alternative embodiment of the head of the fire igniting device of the invention illustrating the alternative means of removably securing the magnesium rod to the side of the head.

FIG. 4 illustrates still another embodiment of the fire igniting device 10 of the invention in which the circular recess 32 for receiving the magnesium rod 12 is positioned to the side of the rod receiving end 28 of head 26.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be restored to without departing from the spirit of the invention.

Now that the invention has been described,

What is claimed is:

1. A fire igniting device, comprising in combination:

a rod composed of an ignitable material;

a pyrophoric element;

means for securing said pyrophoric element to said rod;

a head including a rod receiving end and a case receiving end;

means for removably securing said rod to said rod receiving end of said head, whereby said rod may be removed from said head and discarded allowing a new rod to be installed thereto;

a case for receiving said rod during nonuse and means for removably securing said head to said case;

means for fitting said case to said case receiving end of said head to increase the effective length of said head, thereby providing handle means; and a striker tethered to said casing for shaving particles from said rod and for striking said pyrophoric element to create sparking.

2. The fire igniting device as set forth in claim 1, wherein said means for removably securing said rod to said rod receiving end of said head comprises a groove formed within a proximal end of said rod, a recess formed within said rod receiving end of said head, and means positioned within said recess to removably engage into said groove of said proximal end of said rod allowing removable engagement of said rod within said recess.

3. The fire igniting device as set forth in claim 2, wherein said means for removably engaging said groove positioned within said proximal end of said rod comprises a spring clip loosely positioned within a groove formed within a side wall defining said recess.

4. The fire igniting device as set forth in claim 3, wherein means for removably connecting said case to said case receiving end of said head comprises a groove formed within said case receiving end of said head and means positioned within said case for releasable engagement into said groove in said case receiving end of said head.

5. The fire igniting device as set forth in claim 4, wherein said means for releasably engaging into said groove in said case receiving end of said head comprises a spring clip loosely positioned within a groove located within said case.

6. The fire igniting device as set forth in claim 1, wherein said recess of said rod receiving end of said head is formed along the side of a side wall defining said recess.

7. The fire igniting device as set forth in claim 1, further including keyway means to prevent rotation of said rod when inserted into said recess.

* * * * *